US005322167A

United States Patent [19]

Birutis et al.

[11] Patent Number: 5,322,167

[45] Date of Patent: Jun. 21, 1994

[54] FILE HOLDER

[75] Inventors: Andrius S. Birutis, DuPage County; Ross J. Bourbonnais, Cook County; Gerald R. Klaus, Kane County, all of Ill.

[73] Assignee: Fellowes Manufacturing Company, Itasca, Ill.

[21] Appl. No.: 971,898

[22] Filed: Nov. 3, 1992

[51] Int. Cl.[5] ..... A47F 5/00

[52] U.S. Cl. ..... 211/50; 206/45.25; 211/184

[58] Field of Search ..... 211/50, 55, 184; 206/561, 45.25, 44 R

[56] References Cited

U.S. PATENT DOCUMENTS 4,228,904 10/1980 Dumond ..... 211/55
4,512,541 4/1985 Lietzke ..... 206/45.25 X
4,579,232 4/1986 Fedak ..... 211/50
4,795,196 1/1989 Hyun et al. ..... 211/50 X
4,819,792 4/1989 Christian ..... 206/45.25
4,962,859 10/1990 Kump ..... 211/50
5,148,942 9/1992 Snook ..... 206/561 X

OTHER PUBLICATIONS

A label of the Active File product sold by Neat Ideas. ®, Copyright Date of 1986.

*Primary Examiner*—Robert W. Gibson, Jr.
*Attorney, Agent, or Firm*—Willian, Brinks, Hofer, Gilson & Lione

[57] ABSTRACT

A file holder and organizer is provided that can be used in either a horizontal or vertical direction. The file holder contains at least one removable partition and unitary body constructed of a material suitable for folding to provide the body for the file holder.

27 Claims, 4 Drawing Sheets

FILE HOLDER

BACKGROUND OF THE INVENTION

This invention relates to a file holder and organizer that is adapted to be used in either a horizontal direction or in a vertical direction. More particularly, it relates to a file holder constructed of fiberboard which is easy to assemble by the consumer.

An increasing number of people maintain an office at their home or are establishing small businesses. Because of this increase, that is an expanding need for inexpensive office products. One item is a file holder.

There are numerous types of file holders, including metal file cabinets and the like. These types of holders, however, are heavy, bulky, and difficult to transport. Accordingly, there is a need for a lightweight file holder.

In addition, there is an increasing awareness of the need to protect the environment, particularly by recycling. The file holder of the present invention solves these needs by providing a file holder preferably constructed of fiberboard that can be recycled.

The fiberboard file holder shown in FIGS. 1 and 2 is presently being manufactured. This file holder, however, is constructed from three separated pieces of fiberboard. In addition, the ends of the body of this file holder, as shown in FIG. 2, must be glued or adhered thereby increasing the manufacturing steps. In contrast, the file holder of the present invention is constructed from only two pieces including a unitary body fiberboard cut-out. Thus, the file holder of the present invention is easier to assemble, uses less fiberboard, and accordingly reduces the amount of waste produced in manufacturing the file holder. In addition, unlike metal file cabinets and the like, the file holder of the present invention can be used to contain and organize files and other materials in either a horizontal or a vertical direction.

SUMMARY OF THE INVENTION

The present invention comprises a file holder adapted to be used in either a horizontal direction or a vertical direction and comprises at least one removable partition and a body. When the body is in a vertical direction it comprises a base and four walls with the walls extending substantially vertically upward. The walls include a rear wall, a front wall opposite the rear wall and two opposite side walls, the side walls being substantially perpendicular to the rear wall. The first side wall has at least one vertical slot disposed on its upper portion and the second side wall has at least one corresponding vertical slot disposed on its upper portion. The slots are adapted to receive the removable partition to thereby provide separate compartments within the file holder in which the consumer can place and organize materials.

In the most preferred embodiment, the body comprises a single piece of fiberboard. Accordingly, in this embodiment the base is joined with the rear wall at the lower portion of the rear wall. Each side wall is joined with the rear wall so that they are opposite and at a substantially right angle to the rear wall. The front wall is joined with the base and is opposite to and parallel with the rear wall. Preferably, the vertical height of the base is greater near the rear wall than near the front wall.

In the most preferred embodiment, the body comprises a single piece of fiberboard that can be folded to produce the complete file holder. When the body is in an unfolded state, it includes the rear wall, the front wall, the first side wall, the second wall, and the base. The first side wall is joined with the rear wall. The first side wall further includes: a first side flap joined with the first side wall and having at least one vertical slot; a foot having a prop with the foot joined with the bottom of the first side wall; and a first side front face joined with the first side wall.

The second side wall is joined with the rear wall. The second side wall further includes: a second side flap joined with the second side wall; a foot having a prop with the foot joined with the bottom of the second side wall; and a second side front face joined with the second side wall.

The base is joined with the rear wall and has at its bottom edge two spaced apart retaining slots. The front wall is joined with the base with a retaining flap joined with the front wall. The retaining flap further has two depending tabs which fit in respective two spaced apart retaining slots.

Although the file holder of the present invention can be constructed of any suitable material, it is particularly advantageous if it is constructed of fiberboard because fiberboard is stable and sturdy yet it can be easily folded.

DETAILED DESCRIPTION OF THE INVENTION AND PREFERRED EMBODIMENTS

Figure 5:
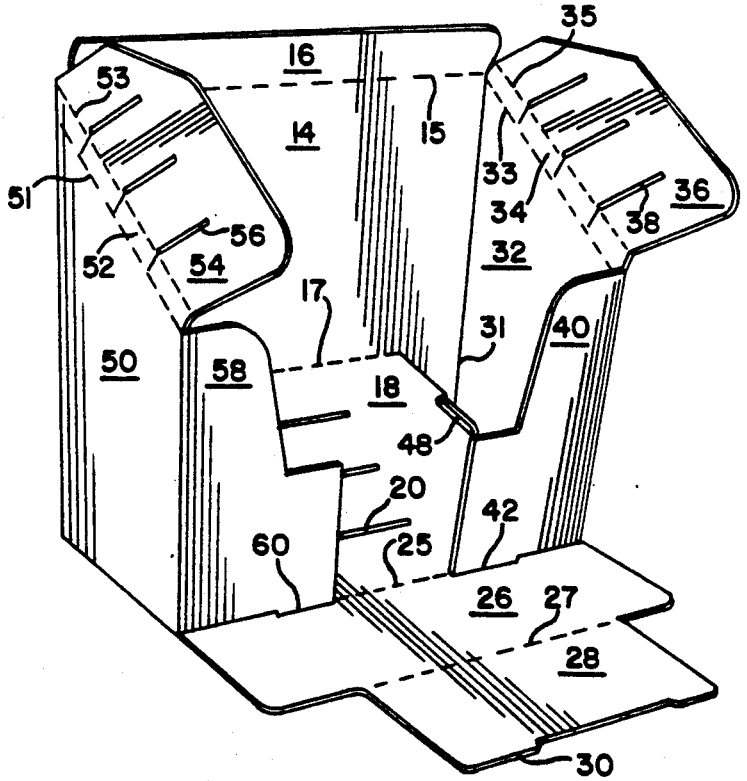
FIG. 5 shows the file holder of FIG. 3 wherein the side faces have been folded toward the rear wall of the file holder and the front face depending tabs have been inserted into the base retaining slots.
Figure 6:
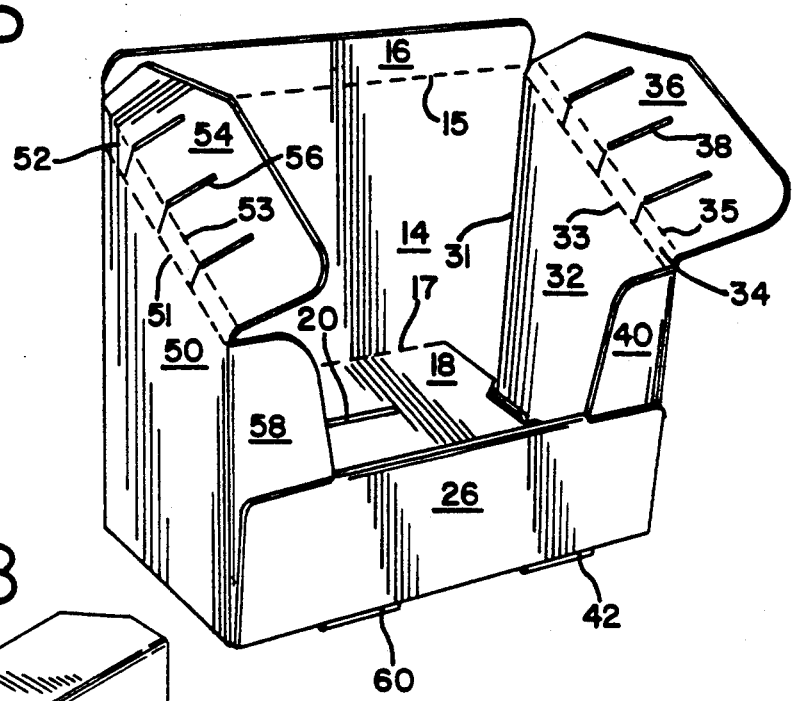
FIG. 6 shows the file holder of FIG. 3 wherein the front wall of the file holder has been folded toward the rear wall and the retaining flap has been folded over the retaining flap tabs inserted into the base retaining slots.
Figure 7:
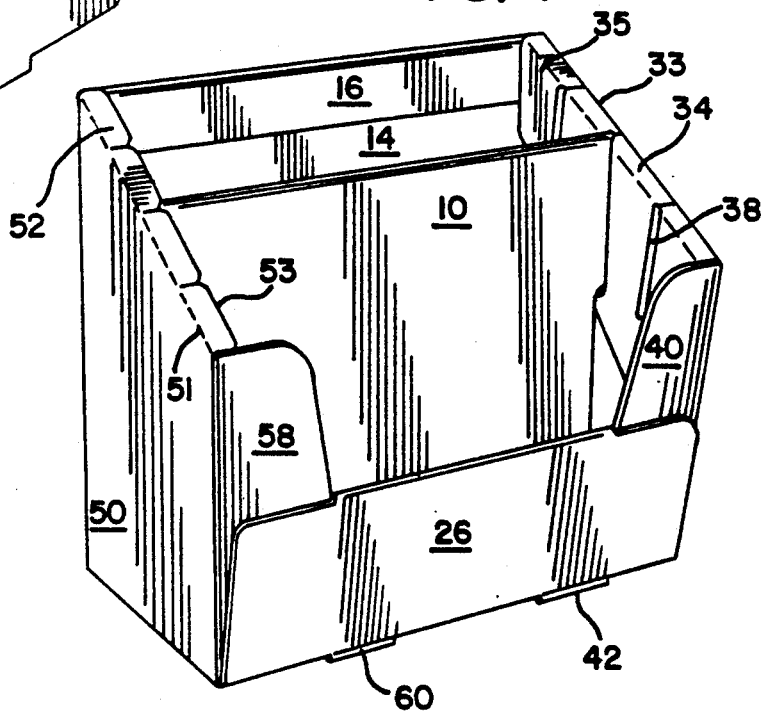
FIG. 7 shows the completed file holder of FIG. 3 wherein the top flap has been folded over and the first and second side flaps have been folded toward the inside of the side walls and with a removable partition member inserted within corresponding vertical slots provided on the side flaps.

In one embodiment of the invention, shown in FIGS. 3–7, the file holder comprises a body 2 and at least one removable partition 10. The body 2 when folded in an assembled condition, as shown in FIG. 7, and such that it is in a vertical position comprises four walls extending substantially vertically upward and a base 18. The walls include a rear wall 14, a front wall 26, a first side wall 32, and a second side wall 50. The side walls 32 and 50 are opposite and at a substantially right angle to the rear wall 14. The rear wall 14 is spaced from and substantially parallel to the front wall 26. Preferably, the base 18 has a greater vertical height near the rear wall 14 wall than near the front wall 26.

Figure 8:
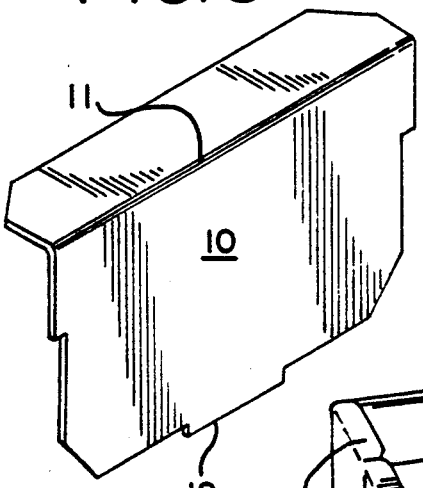
FIG. 8 shows one embodiment of a partition member useful in the present invention.

At least one vertical slot 38 is provided on a flap 36 that is joined with the first side wall 32. At least one vertical slot 56 is provided on a flap 54 that is joined with the second side wall 50. The vertical slot 56 corresponds with and lies in the same vertical plane as the slot 38 to receive the removable partition 10. A plurality of such vertical slots 38 and 56 may be provided to receive a plurality of removable partitions 10. Of course, the partition member 10 is sized and has a width and thickness at its upper portion such that it is able to be received by the vertical slots 38 and 56. The partition member 10, as best seen in FIG. 8, may also have a depending tab 11.

Alternatively, the vertical slots may be provided on the side walls, obviating the need for flaps. In this case, each slot extends from the top edge of the side wall downwardly a portion of the side wall. Of course, the slots on the first side wall will correspond with the slots on the second side wall.

The base 18 may also be provided with at least one slot 20 parallel to the rear wall 14 that corresponds with and lies in the same vertical plane as the vertical slots 38 and 56 to receive a partition member 10 having a depending tab 11 to further secure the partition member 10 in place. Preferably, the number of slots 20 provided on the base 18 corresponds with the number of vertical slots 38 and 56. Of course, more than one partition support slot 20 can be provided to receive any number of partition members 10 as is desired by, among other things, manufacturing and aesthetic considerations.

In a preferred embodiment, the body 2 is constructed as a unitary sheet of material, preferably fiberboard, but can be any other desired material which would be useful in providing a body for the file holder of the present invention. The file holder of the present invention will be described as being constructed from fiberboard.

Figure 1:
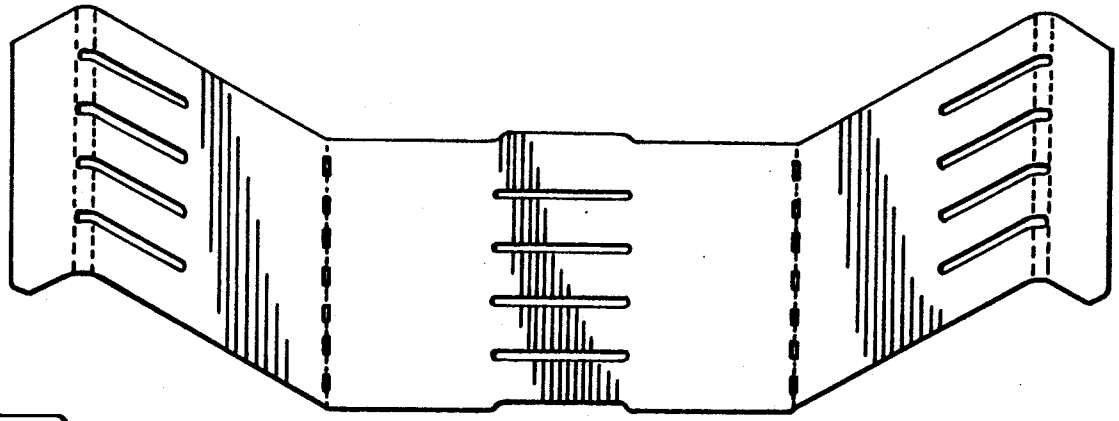
FIG. 1 PRIOR ART
FIG. 1 shows a prior art partition support member that fits within the body of the prior art file holder shown in FIG. 2 to receive a partition member.
Figure 2:
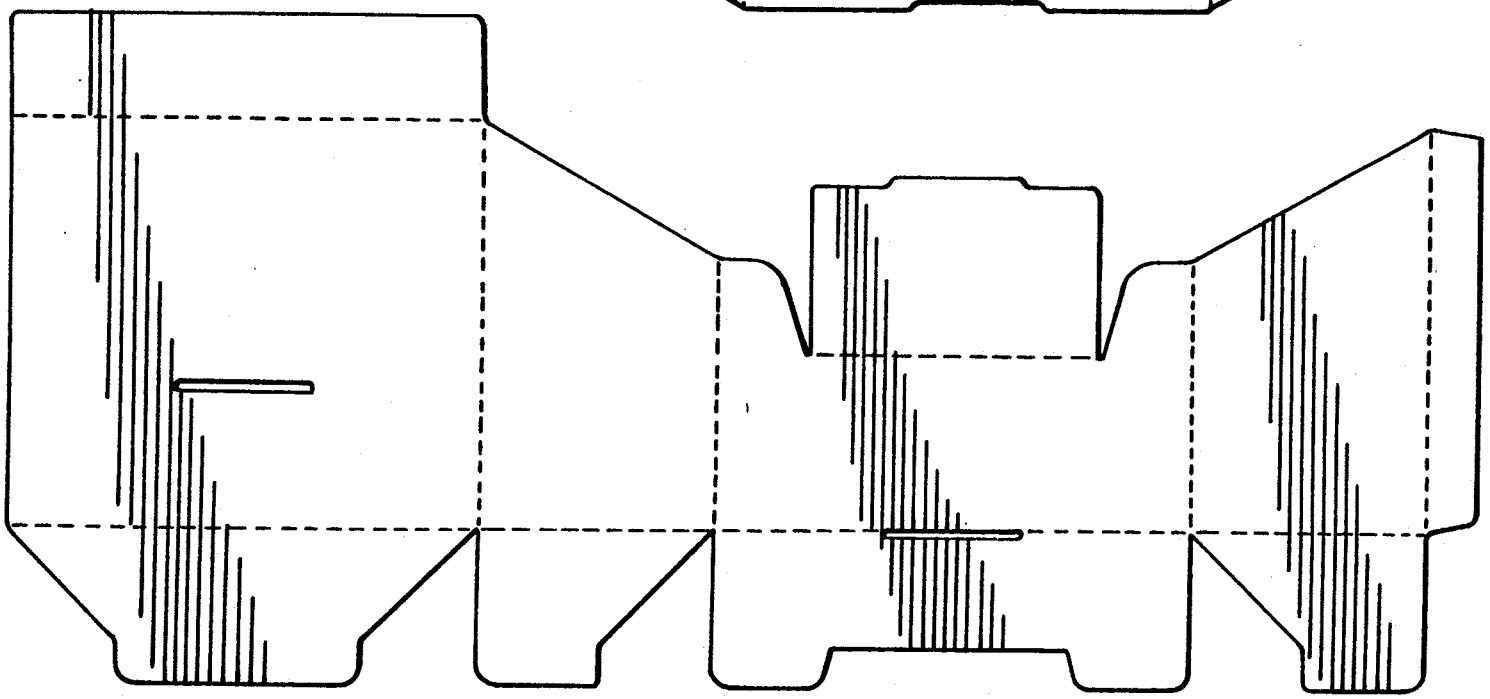
FIG. 2 PRIOR ART
FIG. 2 is a body of a prior art file holder in an unfolded and unglued state.
Figure 3:
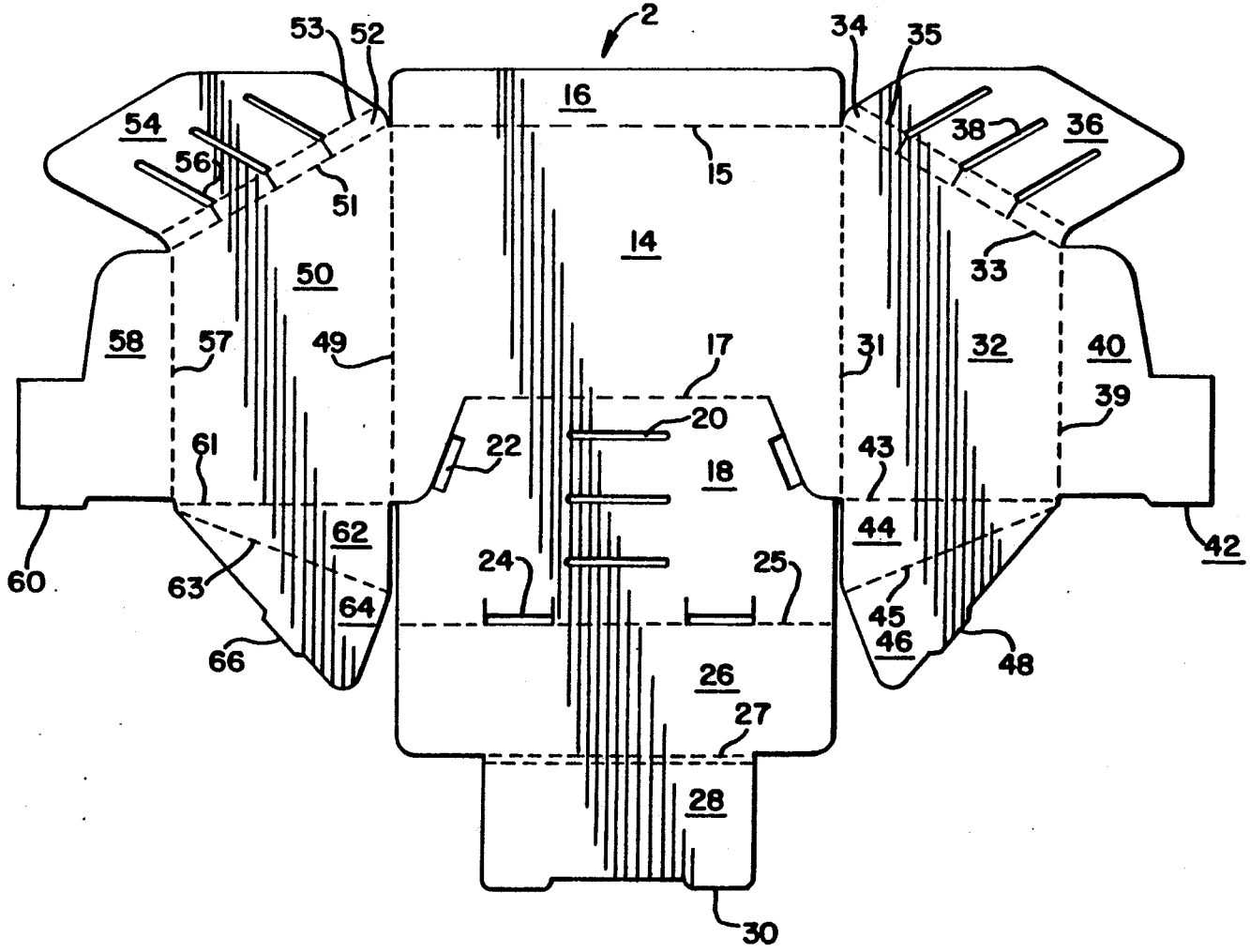
FIG. 3 shows a top view of one embodiment the file holder of the present invention is an unfolded state.

As best seen in FIG. 3, the body 2 of the file holder is shown in an unfolded state. The body 2 comprises a rear wall 14 joined with the base 18, preferably along a base fold 17. Optionally, the base 18 is provided with at least one partition support slot 20 parallel to the rear wall, preferably, located in the approximate center of the base. Since the slot 20 is adapted to receive a tab on a partition member it can be placed anywhere on the base although the support slot 20 is preferably located in the approximate midpoint between the lateral sides of the base 18. Of course, more than one support slot 20 can be provided. For example, a pair of support slots 20 lying in the same plane and parallel to the rear wall may be provided. Alternatively, a row of slots 20, i.e., each lying in the same plane parallel to the rear wall, can be provided.

In another embodiment, a column of slots 20 can be provided such that the column extends from the rear wall 14 toward the front wall 26 with each slot 20 being parallel to the rear wall 14. In yet another embodiment, more than one column of slots 20 can be provided. In the most preferred embodiment, a column of three spaced apart partition support slots 20 are provided on the base.

The base 18 preferably has a pair of base prop slots 22 and a pair of spaced apart base retaining slots 24 at its bottom edge whose functions will be described later. Adjacent to the base retaining slots 24, a front wall 26 is joined with the base 18, preferably along a front wall fold 25.

In the most preferred embodiment, at the end opposite to where the front wall 26 is joined with the base 18, a retaining flap 28 is joined with the front wall 26, preferably along a retaining flap fold 27. The retaining flap 28 preferably has two retaining flap tabs 30 at its edge. In this embodiment, when the body 2 is in a folded condition, the retaining flap tabs 30 are received within the base retaining slots 24 to secure the front wall 26 in a substantially vertical position.

Alternatively, the front wall 26 can be positioned in a substantially vertical position by securing it to the side walls by tape, adhesive, staples and other well known means for securing. Tabs may also be provided on the front wall to attach to the side walls to secure the front wall 26 in a substantially vertical position. Alternatively, tabs may be provided on the side walls to attach to the front wall.

Preferably, the vertical height of the front wall 26 is less than the vertical height of the rear wall 14. In addition, the vertical height of the base 18 near the rear wall 14 is greater than the vertical height near the front wall 26. This sloping condition of the base 14 along with the smaller vertical height of the front wall 26, as best seen in FIGS. 6 and 7, allows material that is stored or placed in the file holder to be easily organized, viewed, and retrieved.

A first side wall 32 is joined with the rear wall 14 preferably along a first side wall fold 31. Most preferably, at the top edge of the first side wall 32, a first side flap 36 is provided. The first side flap 36 is provided with at least one vertical slot 38 adapted to receive a removable partition member 10. When the body 2 of the file holder is in a folded state, the flap 36 extends downward and parallel to the wall 32 so that the vertical slot 38 corresponds with and lies in the same vertical plane as a support slot 20, if provided. Of course, any number of vertical slots 38 may be provided. Most preferably, the first side flap 36 has three vertical slots 38.

In the most preferred embodiment, the first side flap 36 is joined with the first side wall 32, through a first side top edge 34. In this embodiment, the first side top edge 34 is joined with the first side wall 32, preferably along the first side top edge fold 33. The first side flap 36 is joined with the first side top edge 34, preferably along the first side flap fold 35. By providing the top edge 34 to join the flap 36 with the side wall 32, the flap 36, when folded in position, is biased inwardly against a partition member 10 that has engaged the vertical slot 38 to more securely hold the partition 10 in place.

As noted above, the vertical slots may be provided on the side walls 32 and 50. In this case, neither the side flap 36 nor the top edge 34 will be present. Of course, means of providing vertical slots on the sides of the body of the file holder, other than providing the slots on the walls or flaps, are contemplated.

A first side front face 40 is joined with the first side wall 32, preferably, along a first side front face fold 39. Preferably, the first side front face 40 has a depending tab 42 which when the first side wall 32 is folded toward the base 18 and the first side front face 40 is folded toward the rear wall 14, the tab 42 will removably engage the respective base retaining slot 24 to position and secure the side wall 32 at a substantially right angle to the rear wall 44. Alternatively, as noted above, the side wall 32 may be secured or attached to the front wall 26 obviating the need for the front face 40, depending tab 42, and retaining slot 24.

At the bottom edge of the first side wall 32, a first side foot 44 is joined with the first side wall 32, preferably along a first side foot fold 43. A first side prop 46, preferably having a tab 48, is joined with the first side foot 44, preferably along a first side prop fold 45. When the first side 32 is folded toward the base 18, the foot 44 along with the prop 46 is folded to a position underneath the base 18 so that the foot 44 is substantially horizontal. The prop 46 is folded upwardly to a substantially vertical position so that the prop tab 48 removably engages the respective base prop slot 22. In this way, a foot for the body 2 is provided and at the same time the base 18 is supported, preferably in a sloping position so that the vertical height of the base 18 near the rear wall 14 is greater than the vertical height near the front wall 26.

Alternatively, a prop 46 may be joined with the side wall 32. The prop 46 may have a tab 48 in which case the tab will removably engage a base prop slot 22. Alternatively, where no tab 48 is provided the prop 46 will substantially abut the underside of the base 18 to support the base. Of course, a foot 44 may be joined with the side wall 32 so that the prop 46 is joined with the foot 44. In another embodiment, both the prop 46 and the foot 44 are not provided so that the body 2 of the file holder will rest on the bottom edge of the side wall 32.

A second side wall 50, which is preferably identically symmetrical to the first side wall 32, is provided. Accordingly, the second side wall 50 is joined with the rear wall 14, preferably along a second side wall fold 49. At the top edge of the second side wall 50 a second side flap 54 is joined with the second side wall 50. The second side flap 54 is provided with at least one vertical slot 56 adapted to receive a removable partition member 10. When the body 2 of the file holder is in a folded state, the flap 54 extends downward and parallel to the wall 50 so that the vertical slot 56 corresponds with and lies in the same vertical plane as the vertical slot 38 provided on the first side flap 36 and with a support slot 20, if provided on the base 18. Of course, any number of vertical slots 56 may be provided on the second side flap 54. It is preferred that the number of vertical slots 56 provided on the second flap 54 correspond with the number of vertical slots 38 on the first side flap 36.

In the most preferred embodiment, the second side flap 54 is joined with the second side wall 50, preferably along a second side top edge 52. In this embodiment, the second side top edge 52 is joined with the second side wall 50, preferably along the second side top edge fold 51. The second side flap 54 is joined with the second side top edge 52, preferably along the second side flap fold 53. By providing the top edge 52 to join the flap 54 with the side wall 50, the flap 54, when folded in position, is biased inwardly against a partition member 10 that has engaged the vertical slot 56 to more securely hold the partition member 10 in place.

Alternatively, the vertical slots may be provided on the first and second side walls 32 and 50. In this embodiment, the flaps 36 and 54 are not present and the vertical slots will be located at the upper portion of the first and second side walls 32 and 50. Preferably, the slots will extend downwardly from the top edge a portion of the side wall. Of course, the slots will have a thickness sufficient to receive the removable partition 10. Other means of providing vertical slots on the sides of the body of the file holder are contemplated.

A second side front face 58 is joined with the second side wall 50, preferably along a second side front face fold 57. Preferably, the second side front face 58 has a depending tab 60 which when the second side wall 50 is folded toward the base 18 and the second front face 58 is folded toward the rear wall 14, the depending tab 60 will removably engage the respective base retaining slot 24 to position and secure the side wall 50 at a substantially right angle to the rear wall 14. Alternatively, as noted above, the side wall 50 may be secured or attached to the front wall 26 obviating the need for the front face 58, depending tab 60, and retaining slot 24.

At the bottom edge of the second side wall 50, a second side foot 62 is joined with the second side wall 50, preferably along second side foot fold 61. In addition, a second side prop 64, preferably having a tab 66, is joined with the second side foot 62, preferably along a second side prop fold 63. When the second side 50 is folded toward the base 18, the foot 62 along with the prop 64 is folded to a position underneath the base 18 so that the foot 44 is substantially horizontal. The prop 64 is folded upwardly to a substantially vertical position so that the prop tab 66 removably engages the respective base prop slot 22. In this way, a foot for the body 2 is provided while at the same time, the base 18 is supported, preferably in a sloping position so that the vertical height of the base 18 near the rear wall is greater than the vertical height of the base 18 near the front wall 26.

Alternatively, a prop 64 may be joined with the side wall 50. The prop 64 may have a tab 66 in which case, the tab 66 will removably engage a base prop slot 22. Alternatively, where no tab 48 is provided the prop 64 will substantially abut the underside of the base 18 to support the base. Of course, a foot 66 may be joined with the side wall 50 so that the prop 64 is joined with the foot 44. In another embodiment, both the prop 64 and the foot 62 are not provided so that the body 2 of the file holder will rest on the bottom edge of the side wall 50.

Figure 4:
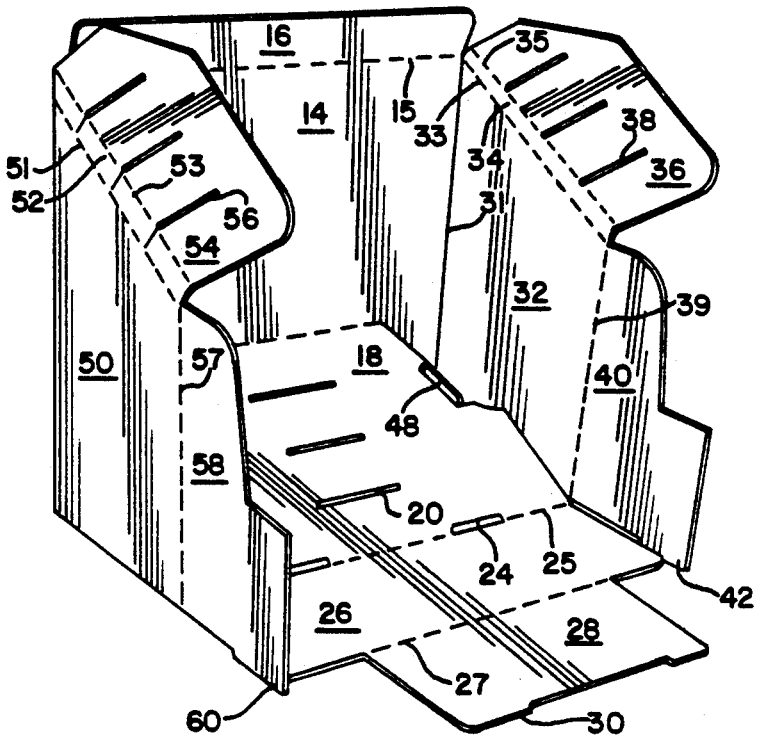
FIG. 4 shows the file holder of FIG. 3 wherein the side walls have been folded toward the base with the feet and the props folded under the base.

The assembly of the file holder including the assembly of the body of the most preferred embodiment will now be described particularly with reference to FIGS. 3-7. As shown in FIG. 3, the body 2 of the file holder is shown in an unfolded state. FIG. 4 shows the body 2 of the file holder in a first step of folding to obtain a completely folded body 2 of the file holder. The first step is to lift the rear wall 14 to a substantially vertical position and then to fold the first side wall 32 toward the base 18 so that the wall 32 becomes at a substantially right angle with respect to the rear wall 14. While moving the first side wall 32 toward the base 18, the first side prop 46 is folded in an upwardly direction along the first side prop fold 45 to a substantially vertical position. The first side foot 44 is also folded along the first side foot fold 43 so that the first side foot 44 is in a substantially horizontal position. In addition, as the first side wall 32 is moved toward the base 18 to a position at a substantially right angle to the rear wall 14, the first side prop tab 48 removably engages the respective base prop slot 22 to provide a support for the base 18 and to provide a foot 44 for the body 2 of the file holder.

The same steps are applied with respect to the second side wall 50. Accordingly, the second side wall 50 is folded along the second side fold 49 toward the base 18 so that the second side wall 50 is at a substantially right angle with respect to the rear wall 14. While moving the second side wall 50 toward the base 18, the second side prop 64 is folded along the second side prop fold 63 in an upwardly direction so that the prop 64 is in a substantially vertical position. The second side foot 62 is also folded along the second side foot fold 61 so that the second side foot 62 is in a substantially horizontal position. As the second side wall 50 is moved toward the base 18 to a position at a substantially right angle to the rear wall 14, the second side prop tab 66 removably engages the respective base prop slot 22 to provide a support for the base 18 and to provide a foot 62 for the body 2 of the file holder. Preferably, the props 46 and 64 support the base 18 in a sloping position so that the vertical height of the base 18 near the rear wall 14 is greater than the vertical height of the base 18 near the front wall 26.

As shown in FIG. 5, the first side front face 40 is then folded along the first side front face fold 39, to bring the first side front face 40 in a parallel relation to the rear wall 14. When the front face 40 is in a substantially parallel relation to the rear wall 14, the front face depending tab 42 removably engages its respective base retaining slot 24.

The second side front face 58 is then folded along the second side front face fold 57, to bring the front face 58 in a substantially parallel relation with the rear wall 14. When the second side front face 58 is in a substantially parallel relation to the rear wall 14, the depending tab 60 removably engages its respective base retaining slot 24.

The front wall 26 is folded along the front wall fold 25 in an upwardly direction so that the front wall 25 is substantially vertical and parallel to the rear wall 14. The retaining flap 28 is folded downwardly along the retaining flap fold 27 so that the retaining flap 28 extends downwardly and parallel to the front wall 26 so that the retaining flap tabs 30 engage respective base retaining slots 24.

The top flap 16 is then folded downwardly along the top flap fold 15 to bias inwardly and against the first side flap 36 and second side flap 54 when the side flaps 36 and 54 are folded downwardly, as best seen in FIG. 7. A fold along the first side top edge fold 33 and the first side flap fold 35 is made to provide the first side top edge 34. The folds are made in a downwardly direction so that the first side flap 36 is in a substantially parallel relation to the first side wall 32. In a like manner, a fold is made along the second side top edge fold 51 and the second side flap fold 53 to provide the second side top edge 52. The second side flap 54 is folded in a downwardly direction so that it becomes substantially parallel to the second side wall 50. In this way, the flaps 36 and 54 extend downwardly opposite each other within the completed body 2.

A partition member 10 is then inserted so that at its upper portion it engages complementary vertical slots 38 and 56 to provide a plurality of compartments for filing and organizing material. Preferably, as best seen in FIG. 8, the partition member 10 has at its bottom edge a partition member tab 12 to removably engage a partition support slot 20 on the base 18. The partition member 10 preferably has at its upper portion a width greater than the width at its lower portion so that the upper portion can be received by the vertical slots 38 and 56. As best seen in FIG. 8, the partition member may also be provided with a fold 11 at its upper portion so that a fold may be made. When such a fold is present, the folded upper portion of the partition is received by the vertical slots 38 and 56. The folded upper portion will bias against the edges of the slots 38 and 56 to more securely engage the partition member 10 within the slots.

As best seen in FIG. 7, the body 2 of the file holder preferably has a rear wall 14 having a vertical height greater than the vertical height of the front wall 26. In this case, the vertical height at the rear of the side walls 32 and 50 is greater than the vertical height at the front. In addition, as noted above, the base 18 preferably has a greater vertical height near the rear wall 14 than near the front wall 26. By providing this sloping difference in vertical height, material that is stored within the file holder is easily retrieved.

While it is to be understood that the body 2 of the file holder was described in a vertical position, the file holder may also be used in a horizontal position. In this case, the outside of the rear wall 14 will rest upon the flat surface, e.g., table, floor and the like, so that papers can be organized in a suitable fashion.

In another embodiment of the file holder of the present invention, the body, in a completely folded state, comprises a unitary body having a rear wall joined with one edge of a base, a front wall joined with the opposite edge of the base so that the front wall is opposite from and parallel to the rear wall. A first side wall is joined with one side edge of the rear wall so that it is at a substantially right angle to the rear wall. A second side wall is joined with the other side edge of the rear wall so that is spaced from and substantially parallel to the first side wall. The front wall is secured to the first and second side walls to form a completed body. The front wall may be secured by providing tabs on the front wall to attach to the tabs to the side walls, by glue, adhesive, tape, and other well known means for securing. Alternatively, the side walls may have tabs that can be attached to the front wall by any well known mans of securing.

At least one vertical slot is provided on the first side wall. The slot extends from the top edge of the first side wall downwardly a portion of the side wall. At least one corresponding vertical slot is provided on the second side wall. The corresponding slot lies in the same vertical plane as the slot provided on the first side wall and extends from the top edge downwardly a portion of the second side wall. Preferably, the base has support slots, as described above. In this way, a removable partition member having a depending tab, as described above, can be removably received by corresponding slots.

In this embodiment, the base preferably has a greater vertical height near the rear wall than near the front wall. In addition, the vertical height of the rear wall may be greater than the vertical height of the front wall. In this case, the vertical height of the side walls near the rear wall may be greater than the vertical height near the front wall. By providing a greater vertical height at the rear of the body than at the front, materials filed and stored within the file holder are more easily organized, viewed, and retrieved.

In another embodiment, the file holder comprises a unitary body having a rear wall joined with one edge of a base, a front wall spaced from and parallel to the rear wall joined with the opposite edge of the base, a first side wall joined with the rear wall and being at substantially right angle to the rear wall, a second side wall joined with the rear wall and being at a substantially right angle to the rear wall so that it is spaced from and substantially parallel to the first side wall. The body also has a first side front face as described above, joined with the first side wall and a second side front face as described above joined with the second side wall. The front faces are substantially parallel to the rear wall and are attached to the front wall by, for example, adhesive, tape, staples, and the like.

While the most preferred embodiment of the file holder comprises a unitary body 2, it is within the scope of the present invention to provide one or more separate parts. For example, one or more of the base, each side wall, the rear wall, and the front wall can be separate pieces. The pieces could then be joined by glue, tape, staples, and other well known means for joining.

Of course it should be understood that a wide range of changes and modifications can be made to the embodiments described above. It is therefore intended that the foregoing description illustrates rather than limits this invention, and that it is the following claims, including all equivalents, which define this invention.

We claim:

1. A file holder and organizer adapted to be used either in a horizontal direction or in a vertical direction comprising:

a. at least one removable fiberboard partition; and b. a unitary fiberboard body, when in the vertical direction comprises a base and four walls with the walls extending substantially vertically upward, the walls including a rear wall, a front wall spaced from and opposite the rear wall and two opposite side walls, each side wall being at a substantially right angle to the rear wall, the first side wall having at least one vertical slot at its top edge and the second side wall having at least one corresponding vertical slot at its top edge, the corresponding slots lying in a plane parallel to the front and rear walls and adapted to receive the removable partition such that when the partition is received in the corresponding slots, the partition lies in a plane parallel to the front and rear walls.

2. The file holder of claim 1 having three partitions and each side wall having three spaced apart vertical slots.

3. The file holder of claim 2 wherein the base is provided with at least one partition support slot parallel to the rear wall.

4. The file holder of claim 5 wherein the partition member has a depending tab adapted to removably engage a partition slot.

5. The file holder of claim 1 wherein the base is provided with a column of three spaced apart partition support slots, the slots being parallel to the rear wall.

6. The file holder of claim 1 wherein the vertical elevation of the base near the rear wall is greater than the vertical elevation of the base near the front wall.

7. The file holder of claim 6 wherein the vertical height of the rear wall is greater than the vertical height of the front wall.

8. The file holder of claim 7 wherein the vertical height of each side wall is greater at the rear than at the front.

9. A file holder and organizer adapted to be used either in a horizontal direction or in a vertical direction comprising:

a. at least one removable fiberboard partition, the partition member having a depending tab;

b. a unitary fiberboard body, when in the vertical direction comprises a base and four walls with the walls extending substantially vertically upward, the walls including i. a rear wall joined with the base, ii. a front wall joined with the base, the front wall spaced from and opposite the rear wall, and iii. two opposite side walls, each side wall joined with and being at a substantially right angle to the rear wall;

c. a first downwardly extending flap parallel to and joined with the first side wall, the flap having at least one vertical slot; and, d. a second downwardly extending flap parallel to and joined with the second side wall, the flap having at least one vertical slot corresponding with the vertical slot on the first flap, the slots being adapted to receive the partition member.

10. The file holder of claim 9 wherein the base is provided with at least one partition support slot parallel to the rear wall and adapted to receive the depending tab of a partition member.

11. The file holder of claim 9 wherein the base is provided with a column of three spaced apart partition support slots, the slots being parallel to the rear wall and adapted to removably engage the depending tab of a partition member.

12. The file holder of claim 9 wherein the vertical elevation of the base near the rear wall is greater than the vertical elevation of the base near the front wall.

13. The file holder of claim 12 wherein the vertical height of the rear wall is greater than the vertical height of the front wall.

14. The file holder of claim 13 wherein the vertical height of each side wall is greater at the rear than at the front.

15. The file holder of claim 9 wherein the rear wall is joined with the base along a base fold, the front wall is joined with the base along a front fold, the first side wall is joined with the rear wall along a first side fold, and the second sides is joined with the rear wall along a second side fold.

16. The file holder of claim 15 further having:

a. a pair of spaced apart base retaining slots provided on the base adjacent the front fold;

b. a first front face joined with the first side wall, the face being at a substantially right angle to the side wall and further having a depending tab that removably engages a base retaining slot; and, c. a second front face joined with the second side wall, the face being at a substantially right angle to the side wall and further having a depending tab that removably engages the other base retaining slot.

17. The file holder of claim 16 further having a retaining flap joined with the front wall and having two depending tabs, each tab removably engaging a base retaining slot when the retaining flap is folded over each front face.

18. The file holder of claim 9 further having:

a. a first prop joined with the first side wall; and, b. a second prop joined with the second side wall such that when the first prop and the second prop are folded underneath the base, the props substantially abut the underside of the base.

19. The file holder of claim 18 wherein a. the base further has a pair of prop slots;

b. the first prop further has a prop tab; and c. the second prop further has a prop tab such that when the first prop and the second prop are folded underneath the base, the first prop tab removably engages one prop slot and the second prop tab removably engages the other prop slot.

20. The file holder of claim 9 further having:

a. a first foot joined with the first side wall;

b. a first prop joined with the first foot;

c. a second food joined with the second side wall; and, d. a second prop joined with the second foot such that when the first foot and the second foot are folded underneath the base, the feet are substantially horizontal and the props substantially abut the underside of the base.

21. A fiberboard file holder and organizer adapted to be used either in a horizontal direction or in a vertical direction comprising:

a. at least one removable partition having a depending tab, the partition having a greater width at its upper portion than at its lower portion;

b. a unitary body, when in the vertical direction comprises a sloping base and four walls with the walls extending substantially vertically upward, the walls including i. a rear wall joined with the base along a base fold, ii. a front wall joined with the base along a front wall fold, the front wall spaced from and opposite the rear wall, iii. a first side wall joined with the rear wall along a first side wall fold and being at a substantially right angle to the rear wall, iv. a second side wall joined with the rear wall along a second side wall fold and being at a substantially a right angle to the rear wall, the base having a greater vertical elevation near the rear wall than near the front wall and further having at least one partition support slot parallel to the rear wall and adapted to receive the partition member depending tab;

c. a first downwardly extending flap parallel to and joined with the first side wall, the flap having at least one vertical slot;

d. a second downwardly extending flap parallel to and joined with the second side wall, the flap having at least one vertical slot corresponding with the vertical slot on the first flap, the first and second flaps adapted to receive the upper portion of the partition member;

e. a pair of spaced apart base retaining slots provided adjacent the front fold;

f. a first front face joined with the first side wall, the face being at a substantially right angle to the side wall and further having a depending tab that removably engages the base retaining slot;

g. a second front face joined with the second side wall, the face being at a substantially right angle to the side wall and further having a depending tab that removably engages a base retaining slot;

h. a retaining flap joined with the front wall and having two depending tabs, each tab removably engaging a base retaining slot when the retaining flap is folded over each front face;

i. a first foot joined with the first side wall;

j. a first prop joined with the first foot;

k. a second foot joined with the second side wall; and, l. a second prop joined with the second foot such that when the first foot and the second foot are folded underneath the base, the feet are substantially horizontal and the props substantially abut the underside of the base.

22. A file holder and organizer adapted to be used either in a horizontal direction or in a vertical direction comprising:

a. three removable fiberboard partitions; and b. a unitary fiberboard body, when in the vertical direction comprises a base and four walls, with the base having at least one partition support slot parallel to the rear wall, and with the four walls extending substantially vertically upward, the walls including a rear wall, a front wall spaced from and opposite the rear wall and two opposite side walls, each side wall being at a substantially right angle to the rear wall, the first side wall having three vertical slots at its top edge and the second side wall having three corresponding vertical slots at its top edge, the corresponding slots adapted to receive the removable partition.

23. The file holder of claim 22 wherein the partition member has a depending tab adapted to removably engage a partition slot.

24. A file holder and organizer adapted to be used either in a horizontal direction or in a vertical direction comprising:

a. at least one removable partition; and a body, when in the vertical direction comprises a base and four walls with the walls extending substantially vertically upward, the base further provided with a column of three spaced apart partition support slots, the slots being parallel to the rear wall, the walls including a rear wall, a front wall spaced from and opposite the rear wall and two opposite side walls, each side wall being at a substantially right angle to the rear wall, the first side wall having at least one vertical slot at its top edge and the second side wall having at least one corresponding vertical slot at its top edge, the corresponding slots adapted to receive the removable partition.

25. A file holder and organizer adapted to be used either in a horizontal direction or in a vertically direction comprising:

a. at least one removable partition; and b. a body, when in the vertical direction comprises a base and four walls with the walls extending substantially vertically upward, the walls including a rear wall, a front wall spaced from and opposite the rear wall and two opposite side walls, each side wall being at a substantially right angle to the rear wall, the first side wall having at least one vertical slot at its top edge and the second side wall having at least one corresponding vertical slot at its top edge, the corresponding slots adapted to receive the removable partition and wherein the vertical elevation of the base near the rear wall is greater than the vertical elevation of the base near the front wall.

26. The file holder of claim 25 wherein the vertical height of the rear wall is greater than the vertical height of the front wall.

27. The file holder of claim 26 wherein the vertical height of each side wall is greater at the rear than at the front.

* * * * *

UNITED STATES PATENT AND TRADEMARK OFFICE

CERTIFICATE OF CORRECTION

PATENT NO. : 5,322,167

DATED : June 21, 1994

INVENTOR(S) : Andrius S. Birutis et al.

It is certified that error appears in the above-indentified patent and that said Letters Patent is hereby corrected as shown below:

ON THE TITLE PAGE

In column 2, line 10, delete "Willian, Brinks, Hofer, Gilson & Lione" and substitute --Willian Brinks Hofer Gilson & Lione".

IN THE CLAIMS

Col. 9,

In claim 4, line 1, delete "5" and substitute --3--.

Col.10,

In claim 15, line 5, delete "sides" and substitute --side--.

Col. 11,

In claim 20, line 4, delete "food" and substitute --foot--.

In claim 21, line 20, delete "a".

UNITED STATES PATENT AND TRADEMARK OFFICE

CERTIFICATE OF CORRECTION

PATENT NO. : 5,322,167

DATED : June 21, 1994

INVENTOR(S) : Andrius S. Birutis, et al

It is certified that error appears in the above-indentified patent and that said Letters Patent is hereby corrected as shown below:

Col. 12, In claim 25, line 2, delete "vertically" and substitute --vertical--.

Signed and Sealed this

Sixth Day of June, 1995

Bruce Lehman

*Attest:*

BRUCE LEHMAN

*Attesting Officer*

*Commissioner of Patents and Trademarks*